US007313520B2

(12) United States Patent
Plummer

(10) Patent No.: US 7,313,520 B2
(45) Date of Patent: Dec. 25, 2007

(54) ADAPTIVE VARIABLE BIT RATE AUDIO COMPRESSION ENCODING

(75) Inventor: Robert H. Plummer, Seattle, WA (US)

(73) Assignee: The DIRECTV Group, Inc., El Segundo, CA (US)

( * ) Notice: Subject to any disclaimer, the term of this patent is extended or adjusted under 35 U.S.C. 154(b) by 0 days.

(21) Appl. No.: 11/434,537

(22) Filed: May 15, 2006

(65) Prior Publication Data

US 2006/0206314 A1 Sep. 14, 2006

Related U.S. Application Data

(63) Continuation-in-part of application No. 10/102,182, filed on Mar. 20, 2002, now abandoned.

(51) Int. Cl.
*G10L 19/14* (2006.01)

(52) U.S. Cl. ..... 704/229; 704/200.1

(58) Field of Classification Search ..... None
See application file for complete search history.

(56) References Cited

U.S. PATENT DOCUMENTS

| | | | | |
|---|---|---|---|---|
| 4,455,649 | A | 6/1984 | Esteban et al. | |
| 5,317,672 | A * | 5/1994 | Crossman et al. | 704/229 |
| 5,323,272 | A * | 6/1994 | Klingler | 360/8 |
| 5,583,922 | A * | 12/1996 | Davis et al. | 379/93.09 |
| 5,764,698 | A | 6/1998 | Sudharsanan et al. | |
| 5,778,338 | A | 7/1998 | Jacobs et al. | |
| 5,862,140 | A * | 1/1999 | Shen et al. | 370/468 |
| 5,893,065 | A | 4/1999 | Fukuchi | |
| 5,933,803 | A | 8/1999 | Ojala | |
| 5,956,674 | A | 9/1999 | Smyth et al. | |
| 5,978,762 | A | 11/1999 | Smyth et al. | |
| 6,012,026 | A | 1/2000 | Taori et al. | |
| 6,092,041 | A | 7/2000 | Pan et al. | |
| 6,098,039 | A | 8/2000 | Nishida | |
| 6,122,338 | A | 9/2000 | Yamauchi | |
| 6,122,668 | A * | 9/2000 | Teng et al. | 709/231 |
| 6,647,366 | B2 * | 11/2003 | Wang et al. | 704/201 |
| 6,704,281 | B1 * | 3/2004 | Hourunranta et al. | 370/230 |
| 2004/0196913 | A1 * | 10/2004 | Chakravarthy et al. | 375/254 |

FOREIGN PATENT DOCUMENTS

WO WO 00/41483 * 7/2000

OTHER PUBLICATIONS

Advanced Television Systems Committee, *Digital Audio Compression Standard (AC-3)*, Doc. A/52, Dec. 20, 1995.

* cited by examiner

*Primary Examiner*—Donald L. Storm

(57) ABSTRACT

An adaptive variable bit rate audio encoder and method that examines audio level information and detects various information in the audio data in a psychoacoustic model to create a quantization value and assign a mode tag to a single frame of audio. A bit rate is assigned according to one of three modes, a self-adaptive mode which is free-running and takes direction only from the characteristics of the incoming audio signal, a managed mode which is controlled by rules set from a statistical multiplexer, and a combination of self-adaptive and managed in which control rules from the statistical multiplexer act to maintain limits on the self-adaptive mode.

20 Claims, 2 Drawing Sheets

ADAPTIVE VARIABLE BIT RATE AUDIO COMPRESSION ENCODING

CROSS-REFERENCE TO RELATED APPLICATION

The present application is a continuation-in-part of U.S. patent application Ser. No. 10/102,182 filed on Mar. 20, 2002, entitled ADAPTIVE VARIABLE BIT RATE AUDIO COMPRESSION ENCODING, now abandoned, which is incorporated by reference herein.

TECHNICAL FIELD

The present invention relates generally to a system and method for compression of digital audio data and more particularly to a system and method for compression of digital audio data having adaptive variable bit rate.

BACKGROUND OF THE INVENTION

Compression of digital audio data is used to reduce bit rate and gain the advantage of better bandwidth utilization. Transmitting data in a compressed format allows a communications link to transmit data more efficiently. By compressing data, gaps, empty fields, redundancies, and unnecessary data are eliminated thereby shortening the length of the data file.

An example of a data compression technique is the Moving Pictures Experts Group (MPEG) standard. MPEG sets forth standards for data compression and may be applied to various signals such as audio and video. MPEG utilizes encoder sub-band filters. Other examples of audio compression techniques that utilize sub-band filtering are Dolby AC-3, PAS, AACS and MP-3.

Presently there are no adaptive variable bit rate audio compression encoders. However, there is an advantage to variable bit rate efficiencies in a statistical multiplexed environment. The current state of the art is a governed, also known as rate controlled, encoder that is more suitable for multiplexing many video and audio streams together. Generally this is used to improve the overall quality of all audio and video within multiplexed video and audio streams without lowering the overall bit rate.

There is a need for an audio encoder to adapt itself, on a frame-by-frame basis, to the requirements of the audio. There is also a need for a "check and balance" method to adapt the encoder assigned bit rate to the requirements of a statistical multiplexer.

SUMMARY OF THE INVENTION

The present invention is an adaptive variable bit rate audio encoder that realizes bit rate reduction and an improvement in bandwidth utilization. The present invention uses audio encoder sub-band filters to realize a variable bit rate mode. According to the present invention, differences between sub-bands are used to detect the frequency response of an audio signal. These differences provide valuable information from the sub-band filters that is applied in an algorithm or a software program, and compared with a psychoacoustic model in a microprocessor, or Digital Signal Processor (DSP) device, which passes the processed information to a statistical multiplexer.

The present invention has three modes of operation, not all of which are dependent on the statistical multiplexer. In one mode of operation, the audio encoder adapts itself to the requirements of the audio signal without the need for the statistical multiplexer. In another mode of operation, the audio encoder adapts the audio parameters to the rules of the statistical multiplexer. And in a third mode of operation the multiplexer is "managed" in that the audio encoder adapts itself after checking the audio parameters against not-to-exceed limits set by a statistical multiplexer and only acts when those limits are exceeded by the audio encoder.

According to the present invention, the statistical multiplexer uses the processed information and passes a quant value back to the audio encoder. The quant value, along with stereo information, allows each audio frame to have a bit rate and a stereo, joint stereo, multi-channel, or monaural tag unique to the audio data contained within each frame. In this regard, the audio encoder may adapt itself to the requirements of the audio, or adapt the audio parameters to the requirements of a statistical multiplexer.

An advantage of a self-adaptive controller is that it is more useful as a stand alone encoder or when it is multiplexing a single video stream giving more capacity to video quality without damaging audio quality. This is particularly advantageous in single stream recording devices as it conserves memory capacity. It is also advantageous to optical media such as DVD.

It is an object of the present invention to compress audio data for transmission. It is another object of the present invention to detect various modes of an audio signal to detect the frequency response of the audio signal.

It is a further object of the present invention to achieve adaptive variable bit rate audio encoding. It is still a further object of the present invention to improve bandwidth utilization through bit rate reduction using a variable bit rate audio compression encoder.

Other objects and advantages of the present invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF PREFERRED EMBODIMENTS

Figure 1:
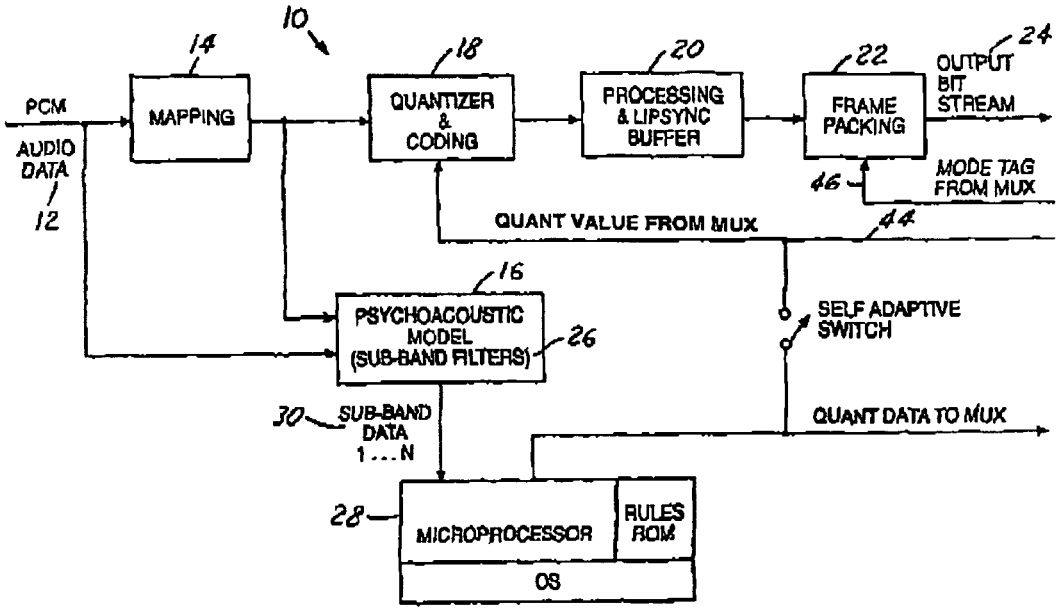
FIG. 1 is a block diagram of an adaptive variable bit rate audio compression encoder of the present invention.

FIG. 1 is a block diagram of the variable bit rate audio compression encoder 10 of the present invention. It should be noted that while the present invention is being described herein with reference to the MPEG-1 audio compression technique, it is easily applied to any audio compression technique that utilizes sub-band filtering, such as Dolby AC-3, PAS, AACS and MP-3. In addition, the present invention is intended to work in a statistical multiplexed environment that could have several to hundreds of video, audio and other types of channels per multiplex.

Typically, a single audio compression encoder is used for each channel in a multi-channel system. A single encoder 10 is shown in FIG. 1. According to the present invention, the encoder 10 receives pulse code modulation (PCM) audio data 12 that is mapped 14 to a psychoacoustic model 16 and quantized and coded 18 in sub-bands having predefined resolutions. The data is buffered 20, frame packed 22, and output as a bit stream 24 to a statistical multiplexer (not shown in FIG. 1). According to the present invention, the statistical multiplexer may or may not affect the bit rate that is assigned by the encoder. In one mode of operation, the statistical multiplexer is not used at all. In another mode of operation, the statistical multiplexer sets a limit for the bit rate assigned by the encoder. In yet another mode of operation, the statistical multiplexer merely checks the bit rate assigned by the encoder, and then alters it if it exceeds the limits set by the statistical multiplexer.

In the prior art (not shown) the psychoacoustic model typically creates a set of data to control the quantizer and coding. According to the present invention, a plurality of sub-band filters 26, that are an existing part of the psychoacoustic model 16, are used to detect various information in the audio data 12 that is, in turn, used to indicate and assign bit rate requirements. Some examples of the information detected within each sub-band would be the absence of a signal, which indicates silence, and/or absolute amplitudes of a signal.

Sub-band filters 26 divide the audio spectrum of 20 Hz to 20,000 Hz into discrete chunks of bandwidth. For example, 20 Hz to 200 Hz may be a single sub-band. A typical Dolby AC-3 coder uses seventeen sub-bands across the audio spectrum at a predetermined sample rate. The examined audio data taken from the sub-band filters is used in a software program in order to perform a comparison to a psychoacoustic model. A bit rate is then assigned by the audio encoder on a frame-by-frame basis.

In one embodiment of the present invention, the statistical multiplexer "checks" the assigned bit rate. Once the bit rate is assigned, the statistical multiplexer will decide if it is an allowable bit-rate or not, and then either allow it, or require the encoder to adapt to limits set by the statistical multiplexer. A good bit rate being determined by comparison of the assigned bit rate to limits set by the statistical multiplexer.

According to the present invention, a microprocessor 28, or other digital signal processor device, on the encoder side of the system, receives all of the sub-band data 30 from the sub-band filters 26. Audio data from the sub-band filters is collected, processed, and used by the encoder to assign a bit rate. The processed data is used in a software program and compared to a psychoacoustic model. After a bit rate is assigned, each frame of the sub-band data is sent to a statistical multiplexer (not shown in FIG. 1) along with the output bit stream 24. As discussed above, the statistical multiplexer may or may not be involved in adjusting the assigned bit rate.

The information that is used by the digital signal processor is audio data within each sub-band, which could be no signal, indicating silence, or absolute amplitudes. No signal may require the encoder to tag that frame with the lowest bit rate, and if it is true for all channels within a program identification (PID) or service channel identification (SCID), the frame is tagged to be monaural.

Figure 2:
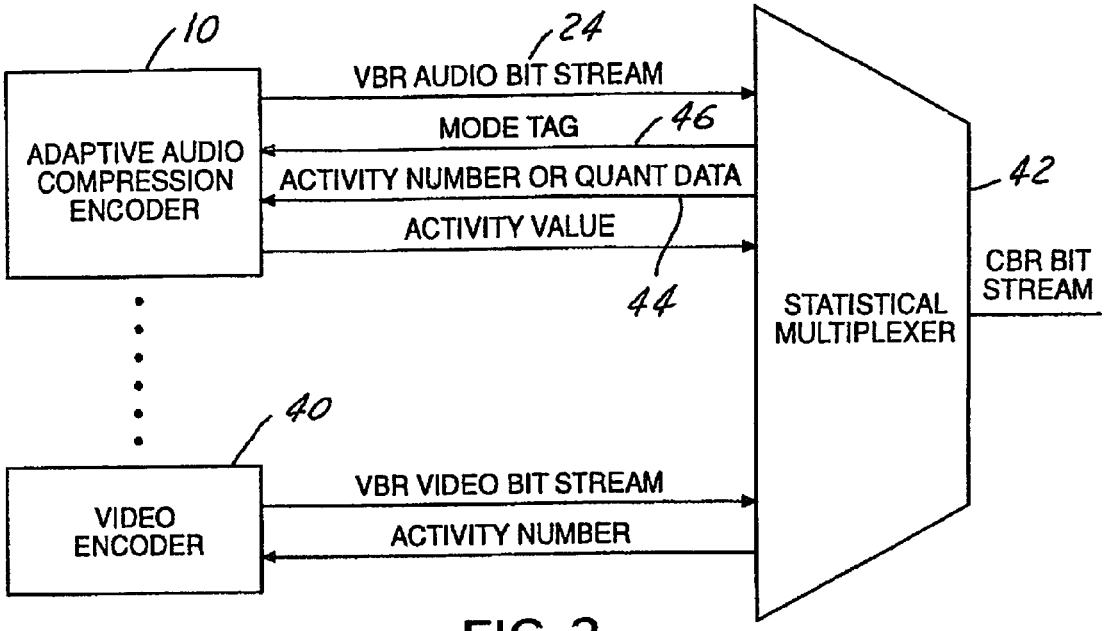
FIG. 2 is a block diagram of the adaptive variable bit rate audio compression encoder of the present invention used in conjunction with a statistical multiplexer.

In the case of multi-channel and stereo, other relevant information provided by the sub-band filters may be balance, lack of balance between channels, equal or unequal frequency response between channels. Simple activity in a channel can be used as an automatic stereo or multi-channel detector and an indicator of bit rate requirements. The more energy in high frequencies, the higher the bit rate requirement for that particular frame. Referring to FIG. 2, an activity value is passed from the encoder to the statistical multiplexer and an activity number is passed from the statistical multiplexer to the encoder.

Additional useful information lies in the differences between sub-bands. The differences between sub-bands can be used to detect the frequency response of the audio signal. Amplitude information in each sub-band indicates the frequency energy in the audio signal in a given frame. Examining the information from each sub-band and applying the result will yield the frequency response of that particular frame of audio. The information that is taken from the sub-band filters may be any useful information within each sub-band and any useful information that lies in the differences between sub-bands. The examined information is used by a software program and compared to the psycho-acoustic model.

The software program in the microprocessor 28 takes the information from the sub-bands and the differences between the sub-bands and puts it into a form that is useful in comparing the data to a psychoacoustic model and ultimately for assigning a bit rate to the audio frame. Referring now to FIG. 2, there is shown a plurality of adaptive audio compression encoders 10 of the present invention, and a video encoder 40. A statistical multiplexer 42 communicates with both the audio encoders 10 and the video encoder 40. The multiplexer 42 is capable of taking in all of the sub-band data 24, including quantization data (QUANT DATA) and coded data, from each of the channels, that has been processed by the microprocessor and calculating a quantization value, also known as a quant value 44 for each encoder. The statistical multiplexer 42 passes the quant value 44 back to the respective encoder. A mode tag 46 is also assigned to the encoder 10 from the statistical multiplexer 42. CBR bit stream is a constant bit rate stream and VBR is a variable bit rate video bit stream.

Referring back to FIG. 1, the quant value 44 and mode information 46 from the statistical multiplexer allows each audio frame to have a bit rate and a stereo, joint-stereo, multi-channel, or monaural mode tag unique to the audio data contained within each frame. The bit rate assigned by the encoder to each frame may be selected from a look-up table, it may be linearly adaptive, or it may be a calculated rate. This operation takes place regardless of the mode of operation of the present invention, whether the encoder is self-adapting, or being adjusted based on a comparison to the limits of the statistical multiplexer. The encoder uses the comparison data from the microprocessor to assign a bit rate on a frame-by-frame basis.

In any event, the present invention allows the audio encoder 10 to adapt itself to the requirements of the audio. Or, in the alternative, the present invention allows the audio encoder 10 to adapt the audio parameters to the requirements of the statistical multiplexer. For example, information from a multiplexer could require an encoder to adapt its frequency response or mode due to multiplexer loading requirements at a particular instant in time, frame, or parameters and priorities set in the multiplexer's management software. It is also possible for the multiplexer management software to set "not-to-exceed" limits. For example, an individual channel may have a limit set not to exceed 112 Kb/sec. in any mode.

Figure 3:
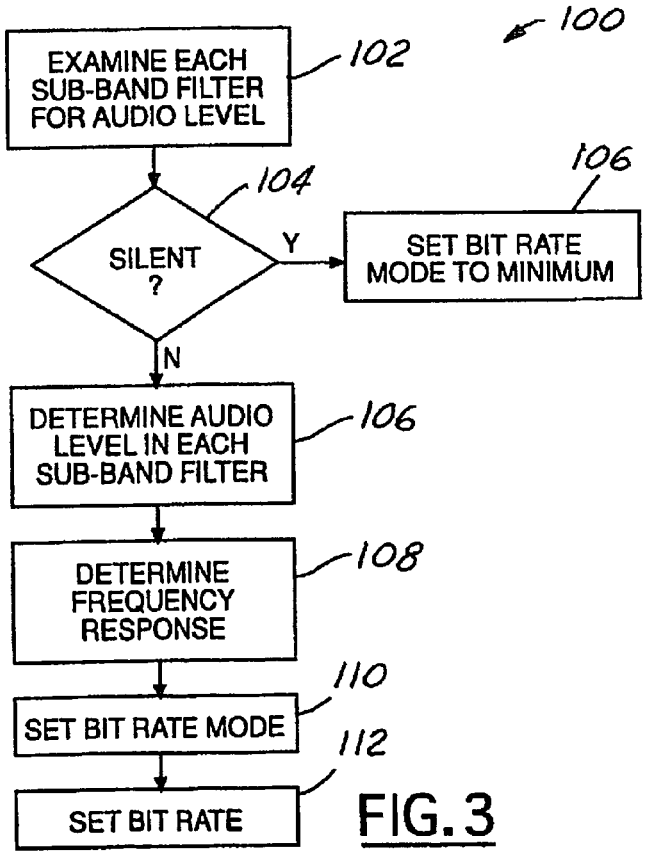
FIG. 3 is a flow chart of the method of the present invention.

FIG. 3 is a flow chart of the method 100 of the present invention. Each sub-band filter is examined 102 for audio level. If the sub-band filter is silent, i.e. no audio, the bit rate is set 104, preferably to a minimum. If there is audio, the level of audio is determined 106 for each sub-band filter. From the audio level, the frequency response if determined 108. The bit rate mode is set 110 from the frequency response. The bit rate is set 112 from the frequency response and the level of audio.

Therefore, according to the present invention, instead of demanding frame-by-frame consistency, each frame can be individualized. In addition, groups of frames may be adapted together. For example, frames having the same bit rate and mode are one group, and the next frames having a different bit rate and mode comprise another group.

When grouping frames, audio buffer levels must be managed with care to avoid decoder buffer underflow or overflow, while maintaining lip sync with video signals. Audio buffer levels are derived from the formula:

$$\text{Total_Bits}=(\text{End-to-End_Delay})(\text{Audio_Bitrate})$$

where audio end-to-end delay is determined from video end-to-end delay, such that lip sync is adequately achieved in a television signal for example. Referring again to FIG. 2, the video encoder 40 sends a video bit stream to the statistical multiplexer 42. This is managed along with the audio buffer levels as described above to ensure lip sync is maintained between the audio and video signals.

According to the present invention, there are at least three modes of operation for the adaptive variable bit rate audio compression encoder of the present invention. The self-adaptive mode of operation is free running and takes direction only from the characteristics of the incoming audio signal. A managed mode of operation is controlled by rules set from the statistical multiplexer. The third mode is combination of the first two modes. The third mode is a self-adaptive mode of operation having limits set by the statistical multiplexer, whereby the statistical multiplexer acts to limit the self-adaptive encoder only when the limits set by the statistical multiplexer are exceeded.

The third mode is advantageous in that it allows the encoder to adapt as needed while only being limited by the statistical multiplexer on an "as-needed" basis. For example, the encoder can maintain itself by following the energy in the natural audio, at least in the downward direction. If the audio is silent with low bandwidths, the encoder would adapt itself to lower bit rates without being forced to do so by the statistical multiplexer. The statistical multiplexer then acts as a safety valve for excess bit rate by maintaining limits only.

The invention covers all alternatives, modifications, and equivalents, as may be included within the spirit and scope of the appended claims.

What is claimed is:

1. A method for adaptive variable bit rate audio compression encoding comprising the steps of:

examining an audio level of a single frame of an audio signal from at least one sub-band filter in at least one encoder;

detecting information in the single frame of examined audio level;

retrieving the detected information from the single frame of examined audio level of the at least one sub-band filter;

applying the retrieved information to a digital signal processor for processing the information including said audio level;

comparing the processed information in a software program with a psycho-acoustic model in the at least one encoder;

assigning a bit rate, in which the at least one encoder assigns the bit rate to said single frame based on the compared processed information; and compressing the audio signal according to the at least one encoder assigned bit rate.

2. The method as claimed in claim 1 further comprising the step of selecting the assigned bit rate from a look-up table.

3. The method as claimed in claim 1 further comprising the step of calculating the bit rate.

4. The method as claimed in claim 3 further comprising the step of linearly adapting the calculated bit rate.

5. The method as claimed in claim 1 further comprising the step of setting limits in a statistical multiplexer that force the at least one encoder to adapt its bit rate assignment based on loading of the statistical multiplexer at a given point in time.

6. The method as claimed in claim 1 further comprising the step of setting limits in a statistical multiplexer that force the at least one encoder to adapt its bit rate assignment based on loading of the statistical multiplexer for a given frame of audio data.

7. The method as claimed in claim 1 further comprising the step of setting limits in a statistical multiplexer that force the at least one encoder to adapt its bit rate assignment based on priorities set by a software manager in the statistical multiplexer whereby the encoder adapts the assigned bit rate only when it exceeds limits set by the statistical multiplexer.

8. The method as claimed in claim 1 further comprising the step of collecting frames having similar characteristics into a single group for transmission.

9. The method as claimed in claim 8 wherein said similar characteristics further comprise the same bit rate and mode tag.

10. The method as claimed in claim 8 further comprising the steps of:

determining audio buffer levels to avoid underflow and overflow; and maintaining lip sync with a video signal.

11. The method as claimed in claim 1 wherein the step of assigning a bit rate further comprises the step of limiting the at least one encoder by following energy in the audio signal whereby the at least one encoder adapts the assigned bit rate independent of input from a statistical multiplexer.

12. The method as claimed in claim 11 wherein the statistical multiplexer checks the assigned bit rate against predetermined limits and the encoder assigns a new bit rate in the event the checked bit rate exceeds the predetermined limits.

13. A system for adaptive variable bit rate audio compression comprising:

at least one encoder having a psychoacoustic model having a plurality of sub-band filters;

a microprocessor receiving audio data for a single audio frame from the plurality of sub-band filters and processing the received audio data from the plurality of sub-band filters, the microprocessor using a software program for comparing the processed data selected from the plurality of sub-band filters with the psychoacoustic model;

a statistical multiplexer in communication with the at least one encoder and the microprocessor, the statistical multiplexer having predetermined limits set for the at least one encoder;

the at least one encoder receiving a quant value, bit rate and mode tag from the statistical multiplexer, the at least one encoder receiving the comparison data from said microprocessor to assign a bit rate to the single frame.

14. The system as claimed in claim 13 further comprising a look up table for assigning a bit rate to the single frame of audio data.

15. The system as claimed in claim 13 further comprising a software program for calculating a bit rate for the single frame of audio data.

16. The system as claimed in claim 13 further comprising a formula for linearly adapting the bit rate for the single frame of audio data.

17. The system as claimed in claim 13 wherein the statistical multiplexer further comprises limits for the at least one encoder based on a load applied to the statistical multiplexer at a given point in time.

18. The system as claimed in claim 13 wherein the statistical multiplexer further comprises limits for the at least one encoder based on a load applied to the statistical multiplexer for a given frame of audio data.

19. The system as claimed in claim 13 wherein the statistical multiplexer further comprises a software manager having priorities that set limits for the at least one encoder.

20. The system as claimed in claim 19 wherein said statistical multiplexer further comprises a software manager having priorities that set limits for the at least one encoder whereby the bit rate assigned by the at least one encoder is adjusted based on the limits set by the statistical multiplexer.

* * * * *